US010391548B2

(12) United States Patent
Takahashi

(10) Patent No.: US 10,391,548 B2
(45) Date of Patent: Aug. 27, 2019

(54) CASTING DEVICE AND CASTING METHOD

(71) Applicant: Nissan Motor Co., Ltd., Yokohama-shi, Kanagawa (JP)

(72) Inventor: Masaya Takahashi, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 15/579,675

(22) PCT Filed: Jun. 25, 2015

(86) PCT No.: PCT/JP2015/068309
§ 371 (c)(1),
(2) Date: Dec. 5, 2017

(87) PCT Pub. No.: WO2016/208027
PCT Pub. Date: Dec. 29, 2016

(65) Prior Publication Data

US 2018/0141110 A1 May 24, 2018

(51) Int. Cl.

| | |
|---|---|
| ***B22C 9/06*** | (2006.01) |
| ***B22D 17/22*** | (2006.01) |
| ***B22C 9/10*** | (2006.01) |
| ***B22C 9/12*** | (2006.01) |

(52) U.S. Cl.
CPC ..... *B22C 9/06* (2013.01); *B22C 9/10* (2013.01); *B22C 9/12* (2013.01); *B22D 17/22* (2013.01)

(58) Field of Classification Search
CPC .. B22C 9/065; B22C 9/06; B22C 9/10; B22C 9/12; B22D 17/2038; B22D 17/22; B22D 17/2218; B22D 27/04; B22D 30/00; B22D 15/00; B22D 15/04
See application file for complete search history.

(56) References Cited

U.S. PATENT DOCUMENTS 4,161,980 A * 7/1979 Ruger ..... H01L 23/473 165/168
4,665,969 A * 5/1987 Horst ..... B22D 11/04 164/439
5,421,397 A 6/1995 Hembree et al.
(Continued)

FOREIGN PATENT DOCUMENTS

CN 1670497 A 9/2005
CN 1743648 A 3/2006
CN 101302958 A 11/2008
(Continued)

*Primary Examiner* — Kevin P Kerns
*Assistant Examiner* — Steven S Ha
(74) *Attorney, Agent, or Firm* — Global IP Counselors, LLP

(57) ABSTRACT

A casting device is provided that carries out casting by supplying molten metal to a cavity (formed inside a casting die in a state in which a core pin is disposed in the casting die. The device casting is provided with a temperature detector and a cooling controller. The temperature detector detects the temperature of the core pin at a predetermined time at an end of one casting cycle. The cooling controller applies cooling energy to the core pin and controls an amount of cooling energy applied to the core pin during a next casting cycle according to the temperature that is detected by the temperature detector.

12 Claims, 11 Drawing Sheets

(56) References Cited

U.S. PATENT DOCUMENTS

| | | | | |
|---|---|---|---|---|
| 6,435,258 | B1 * | 8/2002 | Ogasawara | B22D 27/04<br>164/128 |
| 7,607,827 | B2 | 10/2009 | Karikomi et al. | |

FOREIGN PATENT DOCUMENTS

| | | | |
|---|---|---|---|
| CN | 104203633 | A | 12/2014 |
| JP | 9-1313 | A | 1/1997 |
| JP | 2000-167655 | A | 6/2000 |
| JP | 2005-14036 | A | 1/2005 |
| JP | 2005-118864 | A | 5/2005 |
| JP | 3981832 | B2 | 9/2007 |
| JP | 2010-64129 | A | 3/2010 |
| JP | 2010-155254 | A | 7/2010 |
| JP | 2013-169577 | A | 9/2013 |

* cited by examiner

WATER FLOW TIME TABLE

| | TEMPERATURE DIFFERENCE/°C | WATER FLOW TIME | AIR PURGE |
|---|---|---|---|
| | +α5°C | +β5 sec | FREELY SET |
| | +α4°C | +β4 sec | FREELY SET |
| | +α3°C | +β3 sec | FREELY SET |
| | +α2°C | +β2 sec | FREELY SET |
| | +α1°C | +β1 sec | FREELY SET |
| TARGET VALUE | T°C | WATER FLOW TIME DURING PREVIOUS SHOT + β sec | FREELY SET |
| | -α1°C | -β1 sec | FREELY SET |
| | -α2°C | -β2 sec | FREELY SET |
| | -α3°C | -β3 sec | FREELY SET |
| | -α4°C | -β4 sec | FREELY SET |
| | -α5°C | -β5 sec | FREELY SET |

FIG. 6

CASTING DEVICE AND CASTING METHOD

CROSS-REFERENCE TO RELATED APPLICATIONS

This application is a U.S. National stage application of International Application No. PCT/JP2015/068309, filed Jun. 25, 2015.

BACKGROUND

Field of the Invention

The present invention relates to a casting device and a casting method.

Background Information

A casting device is known in which, in a pressure die casting method of a linerless cylinder bore, a core pin for molding a linerless cylinder bore has a hollow structure, and a cooling pipe is inserted and disposed therein to provide an internal cooling water passage in the central portion of the cooling pipe, while a spiral cooling water passage formed as a spiral groove is provided on the inner circumferential surface of the core pin, which opposes the outer circumferential surface of the cooling pipe, and cooling water is supplied from the internal cooling water passage of the cooling pipe and caused to flow through the spiral cooling water passage, to thereby cool the core pin (Japanese Laid-Open Patent Application No. 2010-155254 referred to herein as Patent Document 1).

SUMMARY

However, in the prior art described above, although stagnation of the flow of the cooling medium can be suppressed to make the surface temperature of the core pin uniform, there is the problem that the temperature of the core pin itself during casting varies with each cycle.

An object to be achieved by the present invention is to provide a casting device and a casting method that can suppress the cyclical variation in temperature of the core pin during casting.

In the present invention, the problem described above is solved by a casting device that carries out casting by supplying molten metal to a cavity formed inside a casting die in a state in which a core pin is disposed in the casting die, wherein the temperature of the core pin at a predetermined time at the end of one casting cycle is detected, and the amount of cooling energy that is applied to the core pin during the next casting cycle is controlled according to this detected temperature.

According to the present invention, since the temperature of the core pin becomes stable at the end of a casting cycle, it is possible to suppress the cyclical variation in temperature of the core pin during casting by controlling the cooling energy that is applied to the core pin during the next casting cycle according to this temperature.

BRIEF DESCRIPTION OF THE DRAWINGS

Referring now to the drawings, a casting device is illustrated.

FIG. 6 is a view illustrating one example of a control table that is stored in the controller illustrated in FIG. 4.

DETAILED DESCRIPTION OF THE EMBODIMENTS

Figure 1:
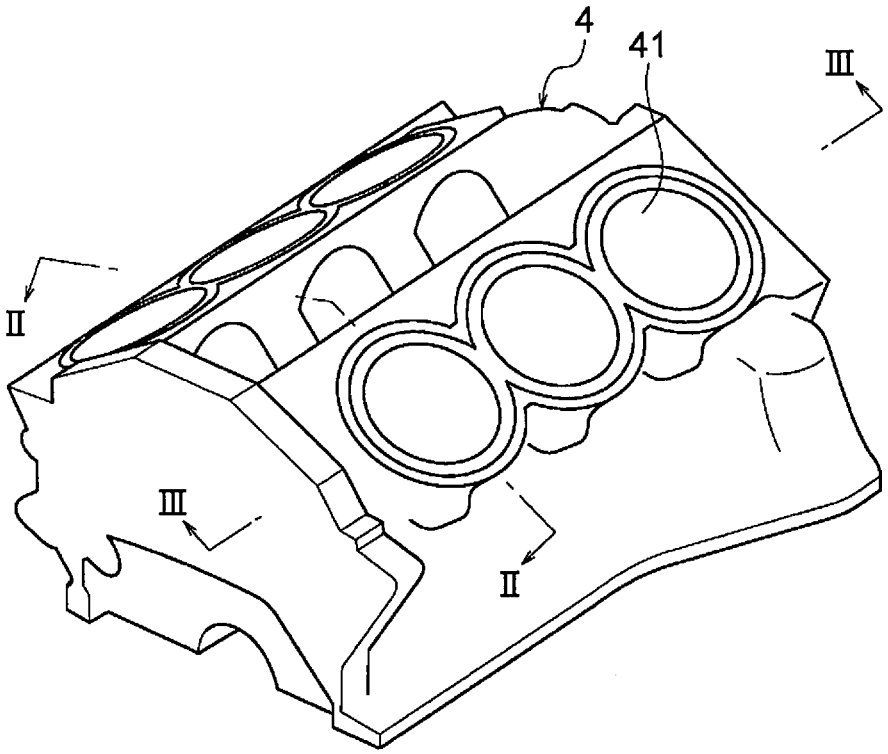
FIG. 1 is a perspective view illustrating a linerless cylinder block to which is applied the casting device and method of the present invention in one embodiment.

Embodiments of the present invention will be explained below based on the drawings. FIG. 1 is a perspective view illustrating one example of a linerless cylinder block 4 (hereinafter also referred to as cylinder block 4) to which the casting device and method according to one embodiment of the present invention is applied, and the illustrated example is an aluminum alloy linerless cylinder block 4 of a V-6 type cylinder engine for automobiles. The cylinder block 4 as this cast product is provided with three cylinder bores 41 on each of the left and right sides. The casting device and the casting method of the present invention are not particularly limited by the form and the specification of the cast product, and can be used without limitation for any purpose of suppressing the generation of blowholes due to cyclical variations in the temperature of the casting die itself. In a cylinder bore 41 of a linerless cylinder block 4, a liner is not inserted and the casting surface becomes the surface of the cylinder bore 41; therefore, the generation of blowholes results in a fatal quality defect. The casting device and the casting method of the present invention will be described below, with respect to an embodiment that has a characteristic feature in the core pin 3 for molding the cylinder block 4 of the linerless cylinder block 4.

Figure 2:
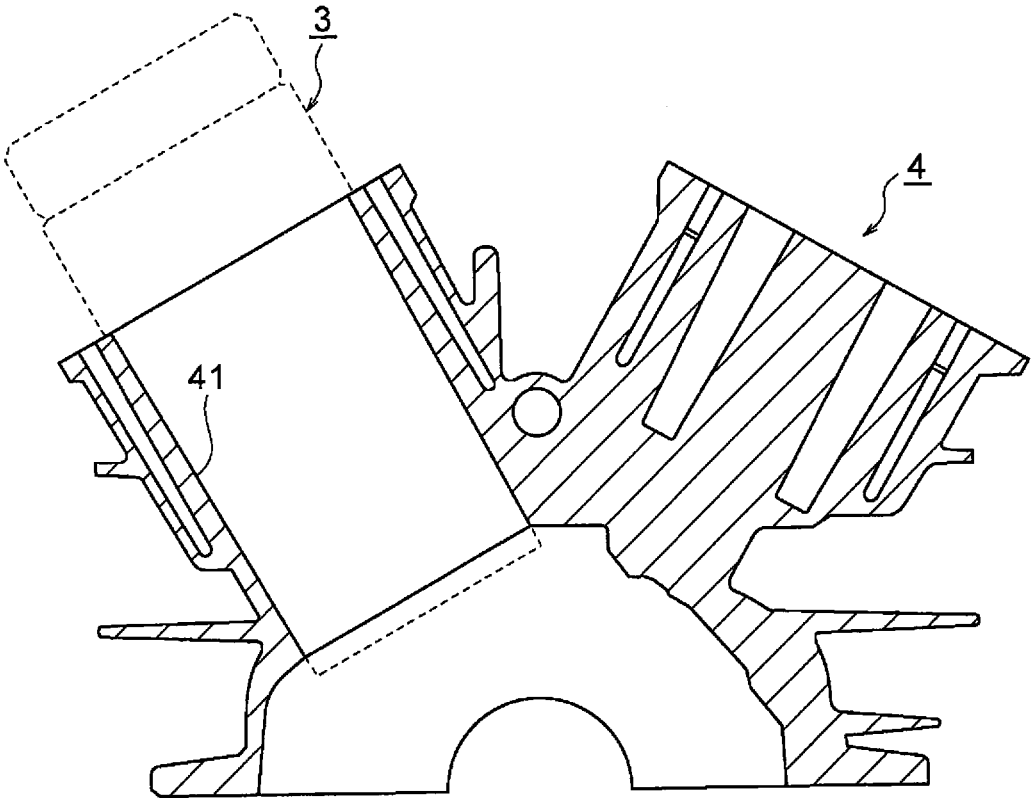
FIG. 2 is a cross-sectional view along line II-II of FIG. 1.
Figure 3:
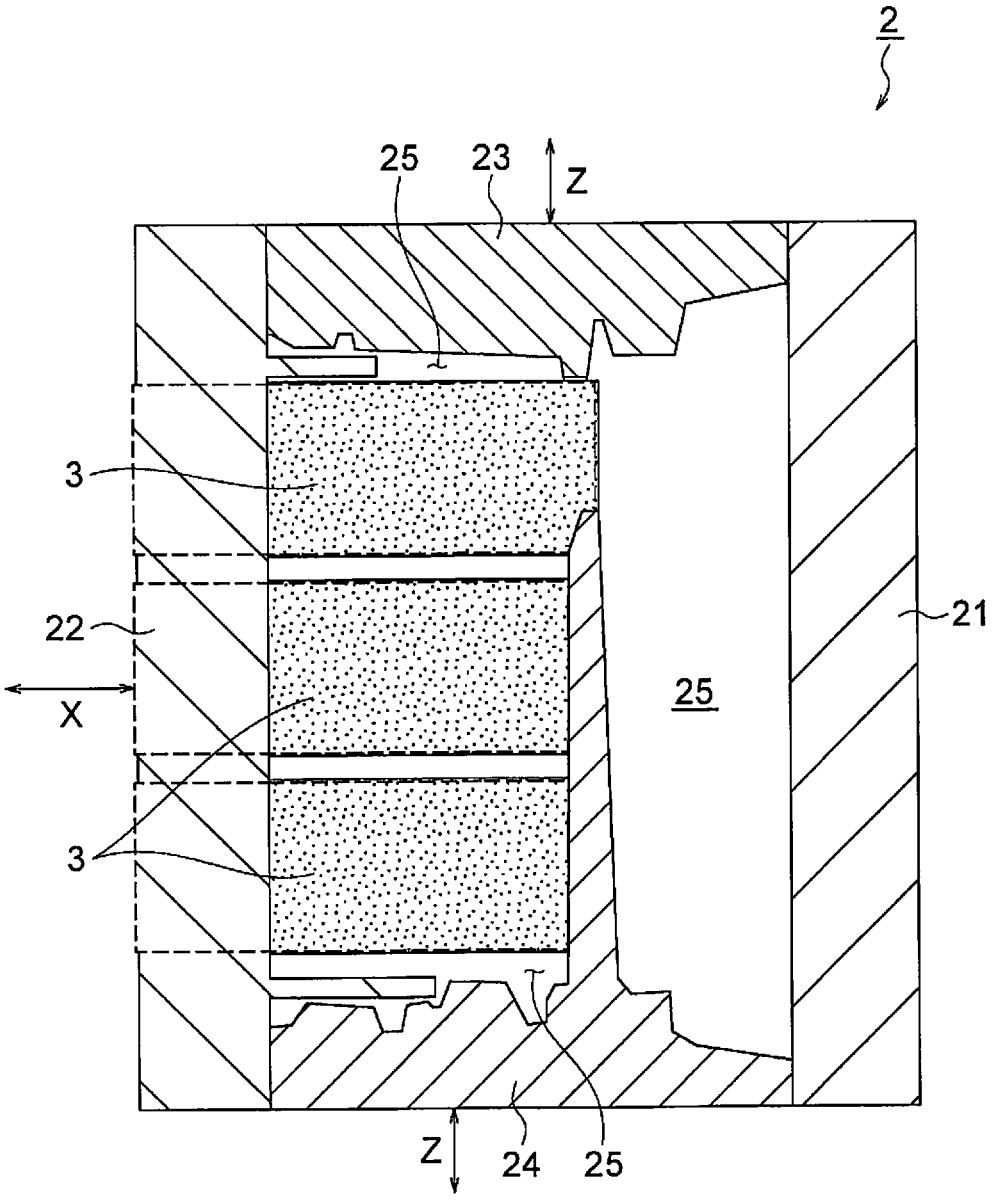
FIG. 3 is a cross-sectional view along line III-III of FIG. 1 illustrating the main casting die of the casting device of the present invention in one embodiment.

FIG. 2 is a cross-sectional view along line II-II of FIG. 1, indicating that the casting die 2 is clamped such that the core pin 3 is positioned in a portion that corresponds to the cylinder bore 41 of the cylinder block 4. FIG. 3 is a cross-sectional view taken along line III-III of FIG. 1, and is a cross-sectional view that illustrates the entire casting die 2. The casting die 2 of the present embodiment is configured as a stationary die 21, a movable die 22 opposing thereto which moves forward and backward in the arrow X direction, and an upper die 23 and a lower die 24, which are provided between the stationary die 21 and the movable die 22, and which respectively move forward and backward in the arrow Z direction. Then, a cavity 25 is formed inside these casting dies in a state in which the stationary die 21, the movable die 22, the upper die 23, and the lower die 24 are clamped as illustrated in FIG. 2, molten metal is injected into this cavity 25 from a pouring hole, which is not shown, and a predetermined pressure is applied for a predetermined period of time, after which the die is opened by causing the movable die 22 to retreat in the X direction, and the upper die 23 and the lower die 24 to retreat in the Z direction, after which the cylinder block 4, which is the product, is released from the die. A casting method in which molten metal, such as molten aluminum, is injected into a precision casting die at high speed and high pressure to instantaneously cast a product, is one of the die casting methods for aluminum casting that is also called pressure die casting (PDC).

Due to the shape of the cylinder block 4 of the present embodiment, the upper die 23 and the lower die 24 are both configured to be capable of moving forward and backward in the Z direction; however, depending on the shape of the cast product, that is, when it is possible to easily release the cast product in the mold releasing step, the casting die may be stationary depending on said shape. In the present embodiment, a core pin 3 is fixed to the movable die 22. Only three core pins 3 are shown in FIG. 3, since cylinder bores 41 of the three cylinders on one side of a V-6 type cylinder engine are shown; however, the number of core pins 3 that are fixed in an actual movable die 22 corresponds to the number of cylinder bores 41.

Figure 4A:
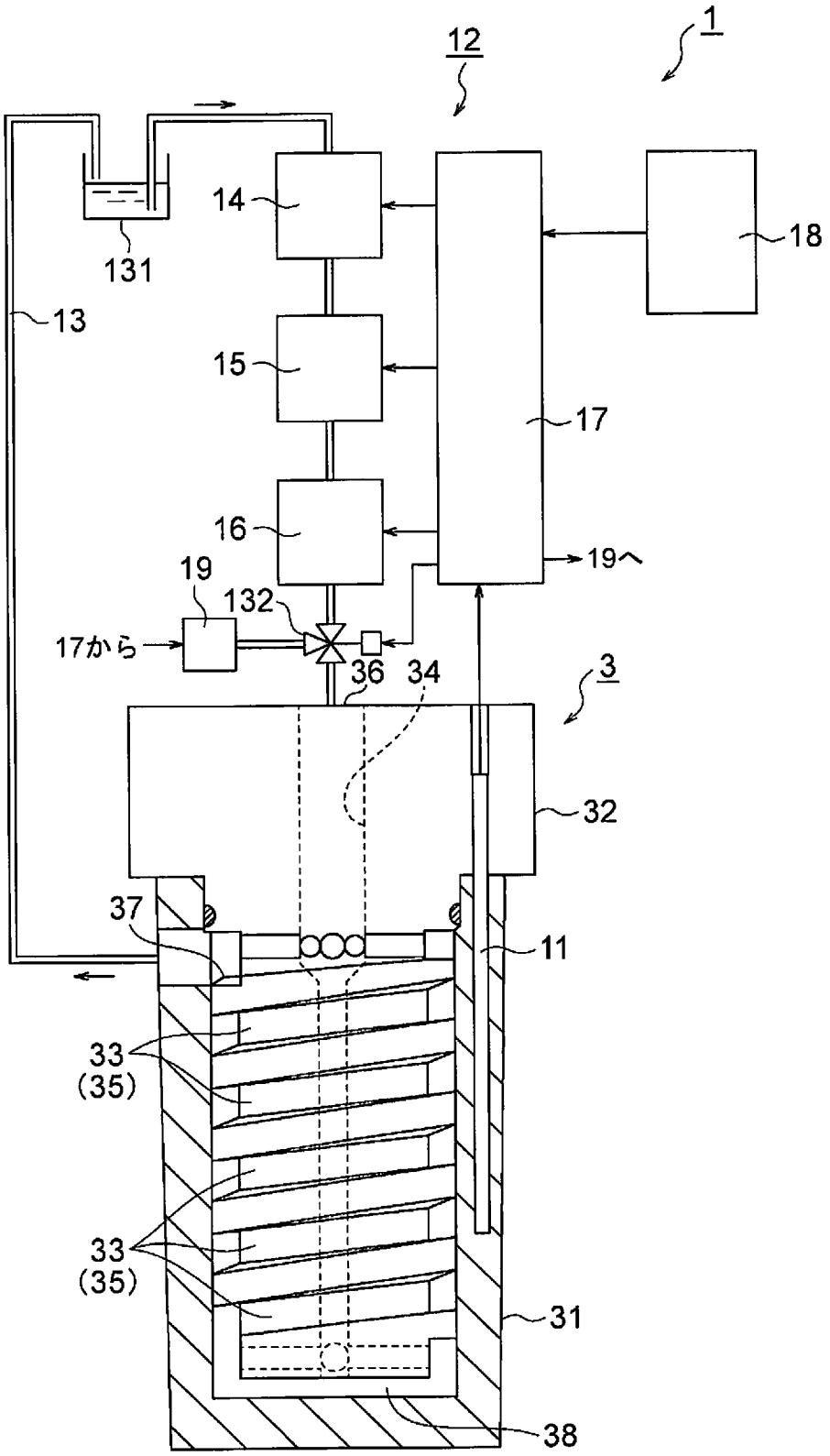
FIG. 4A is a view illustrating the details of the core pin of FIG. 3 and the main configurations other than the casting die of the casting device.
Figure 4B:
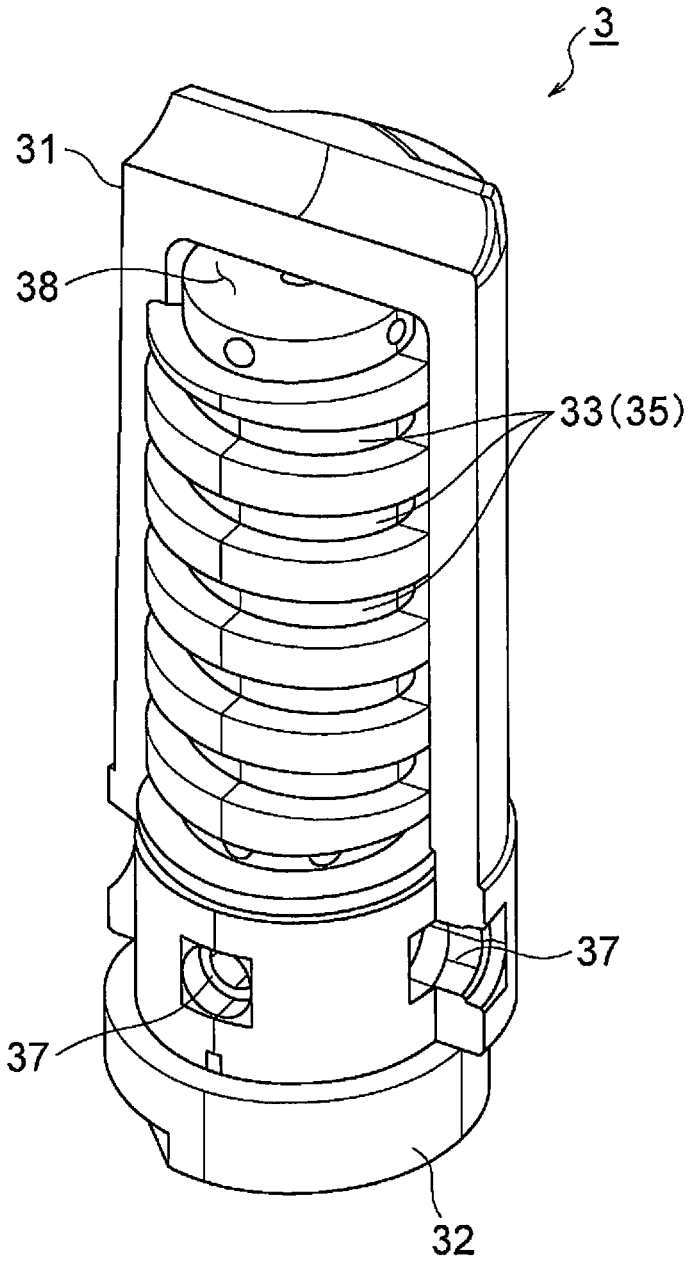
FIG. 4B is a partial cutaway perspective view illustrating the core pin of FIG. 4A.

Since a conventionally well-known means can be employed for the cooling structure of the stationary die 21, the movable die 22, the upper die 23, and the lower die 24, a description thereof is omitted. The cooling structure of the core pin 3 for suppressing the generation of blow holes on the inner surface of the cylinder bore 41 will be described below. FIG. 4A is a view illustrating the details of the core pin of FIG. 3 and the main configurations other than the casting die 2 of the casting device 1, and FIG. 4B is a partial cutaway perspective view illustrating an outline of the core pin 3.

The core pin 3 of the present embodiment comprises an outer cylinder 31 and an inner cylinder 32. The outer cylinder 31 is formed in a bottomed tubular shape, having a bottom portion, an opened top portion, and a cylindrically shaped side wall portion (a cylindrical shape that is slightly tapered in consideration of die-cutting), and the outer surface thereof configures the outer surface of the core pin 3. The inner cylinder 32 has a solid shape in which a spiral groove 33 is formed on the outer surface having an equal pitch with respect to the axial direction, and a through-hole 34 that extends through in the axial direction is formed therein. The inner cylinder 32 is inserted into the outer cylinder 31, as illustrated in FIG. 4B. One end of the spiral groove 33 formed on the outer surface of the inner cylinder 32 (upper end in FIG. 4A, lower end in FIG. 4B) communicates with four refrigerant outlets 37, and the other end of the spiral groove 33 (lower end in FIG. 4A, upper end in FIG. 4B) communicates with a space 38 provided between the bottom portion of the outer cylinder 31 and the distal end portion of the inner cylinder 32. Then, when the inner cylinder 32 is inserted in the outer cylinder 31, the outer surface of the inner cylinder between a spiral groove 33 and an adjacent spiral groove 33 is substantially in contact with the inner surface of the outer cylinder 31, and thereby a spiral flow channel 35 in which the refrigerant flows is formed between the inner surface of the outer cylinder 31 and the spiral groove 33 of the inner cylinder 32.

On the other hand, a through-hole 34 that extends through the inner cylinder 32 is formed at the center of the solid inner cylinder 32 in the axial direction, and the distal end (lower end in FIG. 4A, upper end in FIG. 4B) thereof is branched into a plurality of through-holes. In the view shown in FIG. 4B, the distal end is branched into four through-holes. The distal end of this through-hole 34 communicates with the space 38 provided between the bottom portion of the outer cylinder 31 and the distal end portion of the inner cylinder 32. In addition, the proximal end of the through-hole 34 (upper end in FIG. 4A, lower end in FIG. 4B) communicates with a refrigerant inlet 36 of the inner cylinder 32. If refrigerant is supplied from the refrigerant inlet 36 using the configuration of the outer cylinder 31 and the inner cylinder 32 described above, the refrigerant flows down the through-hole 34, branches into a plurality of branches at the distal end, to reach the space 38. Then, the refrigerant flows through the spiral flow channel 35 in a spiral manner from the distal end of the spiral flow channel 35, which is configured from the spiral groove 33, and cools the outer cylinder 31 at this time. The refrigerant that reaches the proximal end of the spiral flow channel 35 flows out from the refrigerant outlet 37 to the outside of the core pin 3.

In the core pin 3 of the illustrated embodiment, the proximal end of the through-hole 34 is configured as the refrigerant inlet 36, the proximal end of the spiral flow channel 35 is configured as the refrigerant outlet 37, and the refrigerant for cooling the outer cylinder 31 is caused to flow from the distal end to the proximal end of the core pin 3; conversely, the configuration may be such that the proximal end of the spiral flow channel 35 is configured as the refrigerant inlet 36, the proximal end of the through-hole 34 is configured as the refrigerant outlet 37, and the refrigerant for cooling the outer cylinder 31 is caused to flow from the proximal end to the distal end of the core pin 3. However, in the former configuration (the configuration in which the refrigerant is caused to flow from the distal end to the proximal end of the core pin 3), the cooling capability at the distal end side of the core pin 3 is greater than the cooling capability at the proximal end side, and in the latter configuration (the configuration in which the refrigerant is caused to flow from the proximal end to the distal end of the core pin 3), the cooling capability at the proximal end side of the core pin 3 is greater than the cooling capability at the distal end side. Therefore, it is preferable to appropriately select the configuration according to the desired cast product and casting die structure. In the casting die structure of the present embodiment illustrated in FIG. 3, since the temperature at the distal end side of the core pin 3 becomes higher than the temperature at the proximal end side during casting, the former configuration is employed.

Figure 7A:
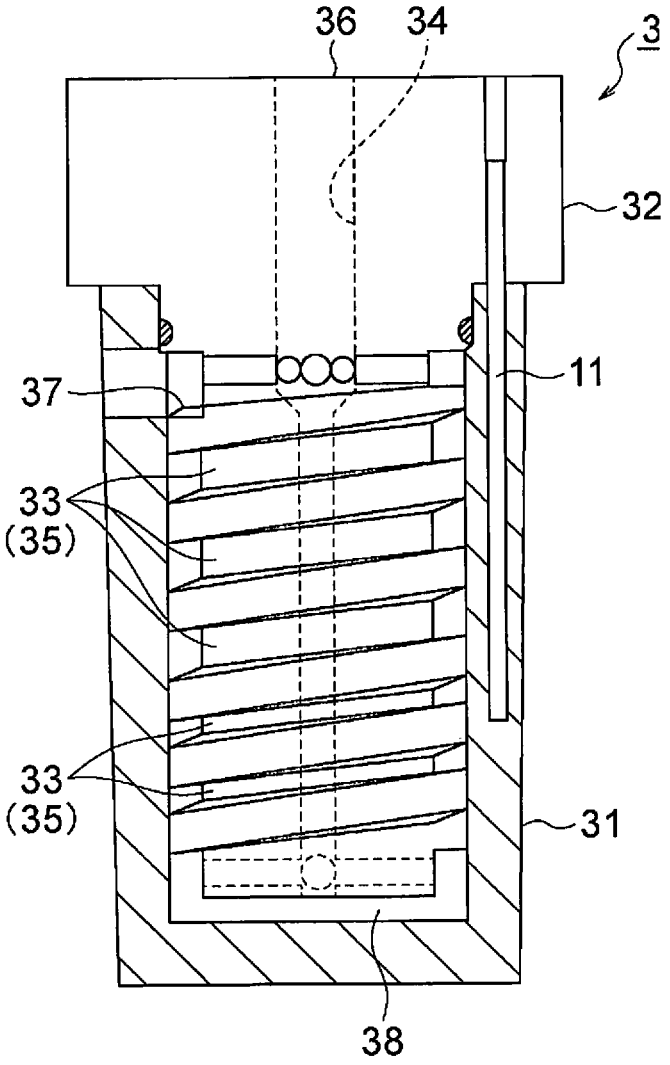
FIG. 7A is a view illustrating another example of the core pin of FIG. 3.
Figure 7B:
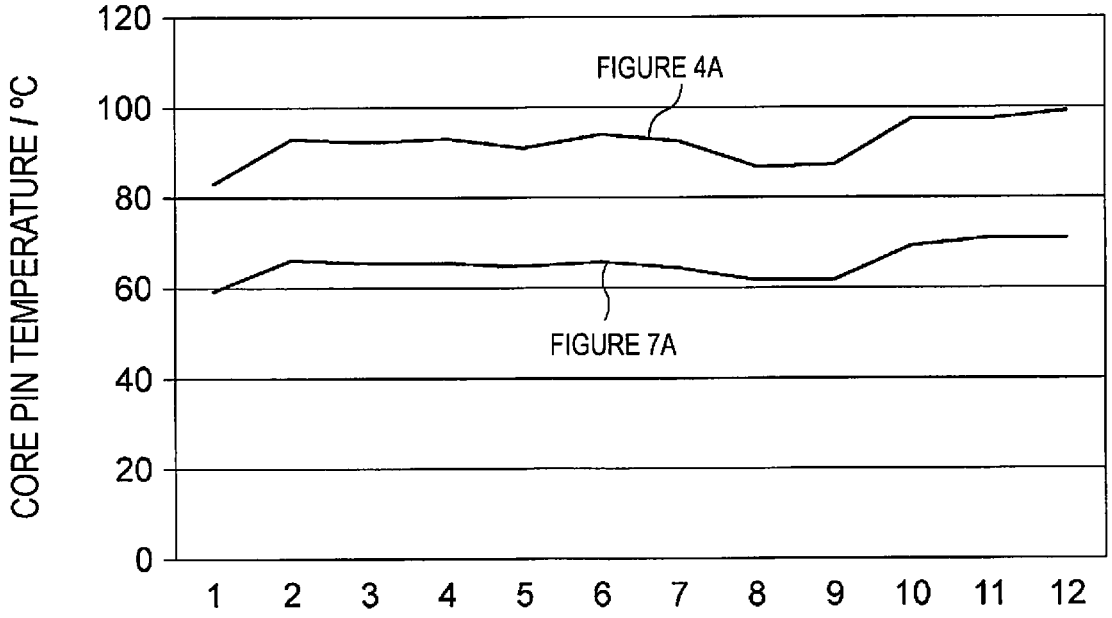
FIG. 7B is a graph illustrating the temperature of the core pin in a case in which casting is carried out a plurality of times respectively using the core pin of FIG. 7A and the core pin of FIG. 3.
Figure 7C:
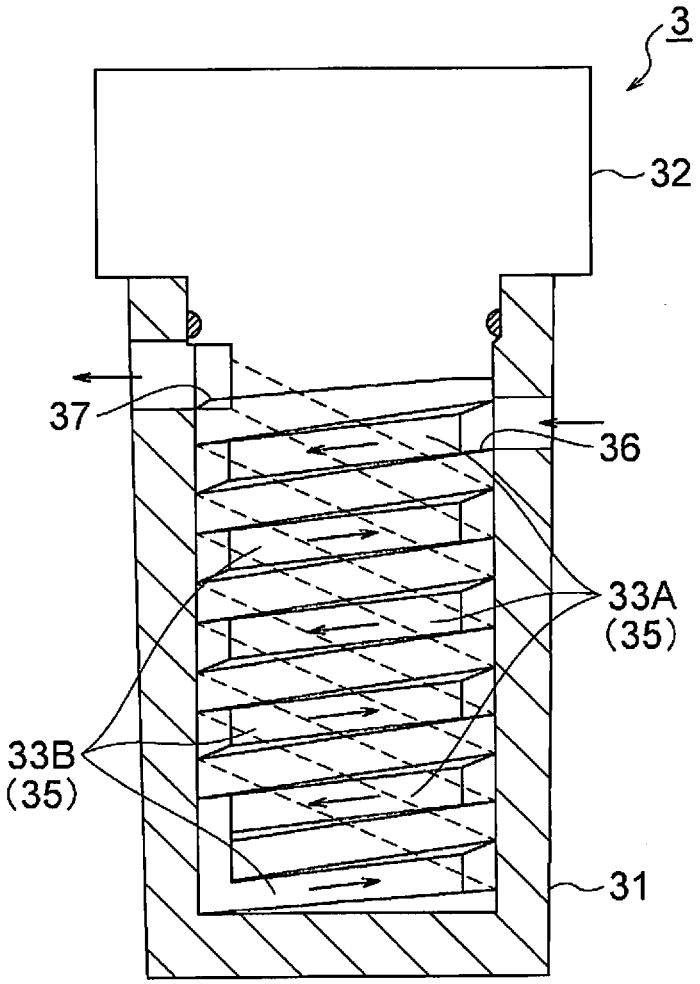
FIG. 7C is a view illustrating yet another example of the core pin of FIG. 3.

Other examples of the core pin 3 include the examples illustrated in FIG. 7A and FIG. 7C. In the embodiment of the core pin 3 illustrated in FIG. 7A, the axial direction pitch of the spiral groove 33, which is formed on the outer surface of the inner cylinder 32 is not configured to be an equal pitch; instead, the pitch on the distal end side is set to be smaller (narrower) than the pitch on the proximal end side. The other configurations are the same as the configuration of the core pin 3 illustrated in FIG. 4A; thus, the corresponding configurations are given the same reference symbols, and the descriptions thereof are omitted. In the illustrated example, the pitch of two spiral grooves 33 on the distal end side is formed to be narrower than the pitch of three spiral grooves 33 on the proximal end side. With this type of configuration, the area of the refrigerant that comes in contact with the outer cylinder 31 becomes larger on the distal end side; therefore, it is possible to make the cooling capability on the distal end side of the core pin 3 greater than the cooling capability on the proximal end side, and to bring the temperature gradient along the axial direction of the core pin 3 as close to zero as possible. When narrowing the pitch of the spiral groove 33, the pitch may be gradually narrowed from the proximal end side toward the distal end side.

While not shown, instead of the setting of the pitch of the spiral groove 33 illustrated in FIG. 7A, the cross-sectional area of the spiral groove 33 on the distal end side of the core pin 3 can be set to be larger than the cross-sectional area of the spiral groove 33 on the proximal end side. Since the area of the refrigerant that comes in contact with the outer cylinder 31 also becomes larger on the distal end side by using this type of configuration, it is possible to make the cooling capability on the distal end side of the core pin 3 greater than the cooling capability on the proximal end side, and to bring the temperature gradient along the axial direction of the core pin 3 as close to zero as possible. When increasing the cross-sectional area of the spiral groove 33, the area can be gradually increased from the proximal end side toward the distal end side.

FIG. 7B is a graph illustrating the result of measuring the temperature of the core pin 3 under the same conditions, when the cylinder block 4 is formed by casting (number of samples N=12) under the same conditions using the core pin 3 illustrated in FIG. 4A (spiral groove 33 is an equal-pitch groove), and the core pin 3 illustrated in FIG. 7A (the pitch of the spiral groove 33 is narrower toward the distal end side). From this result, it was confirmed that by narrowing the pitch of the spiral groove 33 toward the distal end side, as illustrated in FIG. 7A, the temperature is reduced by about 20 degrees compared to when the spiral groove is formed to be an equal-pitch groove. Therefore, by employing the configuration illustrated in FIG. 7A, it is possible to conserve energy for cooling by the cooling controller 12, which is described below, while shortening the cooling time of the casting step.

In the embodiment of the core pin 3 illustrated in FIG. 7C, the spiral groove 33 that is formed on the outer surface of the inner cylinder 32 is configured as double spiral grooves 33A, 33B, and the through-hole 34 formed in the center of the inner cylinder 32 is omitted. In this case, the proximal end of one 33A of the double spiral grooves is configured to be the refrigerant inlet 36, and the distal end of the other 33B is configured to be the refrigerant outlet 37. The distal end of one 33A of the double spiral grooves and the proximal end of the other 33B are connected at the distal end of the inner cylinder 32 (lower end in FIG. 7C). As a result, the refrigerant that flows in from the refrigerant inlet 36 flows toward the distal end of one 33A of the double spiral grooves as indicated by the arrow, reaches the other 33B of the double spiral grooves at the distal end of the inner cylinder 32, then flows in the other 33B toward the proximal end of the inner cylinder 32, and flows out to the outside from the refrigerant outlet 37. By configuring the spiral flow channel 35 from such double spiral grooves 33A, 33B, it is possible to apply cooling energy to the outer cylinder 31 both in the outward and inward directions of the refrigerant, which is efficient. The other configurations are the same as the configuration of the core pin 3 illustrated in FIG. 4A; thus, the corresponding configurations are given the same reference symbols, and the descriptions thereof are omitted.

Again, with reference to FIG. 4A, the casting device 1 of the present embodiment comprises a temperature detector 11 for detecting the temperature of the core pin 3 at a predetermined time at the end of one casting cycle and a cooling controller 12 for applying cooling energy to the core pin 3 and controlling the amount of cooling energy applied to the core pin 3 during the next casting cycle according to the detected temperature that is detected by the temperature detector 11.

The temperature detector 11 is configured from a temperature sensor, such as a thermocouple, as illustrated in FIG. 4A, and is inserted into the outer cylinder 31 and the inner cylinder 32 in order to detect the temperature of the outer cylinder 31. Then, the detection signal of the temperature detector 11 is read by the controller 17 at a predetermined time at the end of one casting cycle. This predetermined time may be any time between time $t_2$, when pressurization is ended in the Nth cycle of the casting step illustrated in the time chart (A) of FIG. 5, and time t0, when the next (N+1)th cycle is started, and more preferably is between time $t_3$, when decompression is ended, and time $t_4$, when purging is ended. The selection of this predetermined time is preferably a period during which the temperature of the core pin 3 becomes stable; therefore, according to the time chart (A) of FIG. 5, which illustrates the temperature profile of the core pin 3, it is preferable for the predetermined time to be between time $t_2$-$t_4$ or time $t_3$-$t_4$, where the rate of change of the temperature of the core pin 3 is small.

The cooling controller 12 is configured comprising a refrigerant pipe (circulation system) 13 for circulating refrigerant in the vicinity of the surface of the core pin 3, a refrigerant tank 131, a circulation pump 14, a temperature regulator 15 that adjusts the temperature of the refrigerant that is supplied to the core pin 3, a flow rate regulator 16 for adjusting the flow rate and the supply time of the refrigerant that is supplied to the core pin 3, an electrically controlled three-way valve 132 provided in the middle of the refrigerant pipe 13, an air pump 19 for supplying air, which connected to one end of this electrically controlled three-way valve 132, and a controller 17 that controls the circulation pump 14, the temperature regulator 15, the flow rate regulator 16, the electrically controlled three-way valve 132, and the air pump 19.

The refrigerant pipe 13 is provided between the refrigerant inlet 36 of the core pin 3 and the refrigerant outlet 37, and a refrigerant tank 131 is provided in the middle thereof. Then, the refrigerant that is stored in the refrigerant tank 131 is drawn by the circulation pump 14 and guided to the refrigerant inlet 36, passed through the spiral flow channel 35 of the core pin 3 described above, and then returned from the refrigerant outlet 37 to the refrigerant tank 131. Water, or the like, may be used as the refrigerant of the present embodiment. In the present embodiment, a refrigerant tank 131 is provided to execute air purging of the refrigerant pipe 13, as described above; however, if air purging is not carried out, the refrigerant tank 131 may be omitted.

An air-cooled or water-cooled heat exchanger type temperature regulator may be used as the temperature regulator 15, which adjusts the refrigerant to a desired temperature according to a command signal from the controller 17. In a case in which the refrigerant is naturally cooled, such as when the refrigerant pipe 13 is sufficiently long, or when the interval of the casting cycle is sufficiently long, the temperature regulator 15 may be omitted.

A flow rate control valve may be used as the flow rate regulator 16, which adjusts the flow rate of the refrigerant according to a command signal from the controller 17. Supplying and stopping of the refrigerant may be controlled by turning the circulation pump 14 ON and OFF, or may be controlled by setting the flow rate of the flow rate regulator 16 to zero (fully closing the opening amount of the flow rate control valve). Therefore, the supplying and stopping of the refrigerant, that is, the supply time of the refrigerant, can be controlled by the circulation pump 14 or by the flow rate regulator 16.

The electrically controlled three-way valve 132 switches the valve so as to supply refrigerant to the core pin 3 while casting is being carried out, and switches the valve so as to supply air from the air pump 19 to the refrigerant inlet 36 of the core pin 3 in order to purge the spiral flow channel 35 of the core pin 3 after casting is ended until casting of the next cycle is started. That is, the valve is operated by a command signal from the controller 17 such that, while cast molding is being carried out, the air pump 19 side valve is closed and the refrigerant pipe 13 side valve is opened, whereas, during purging, the flow rate regulator 16 side valve of the refrigerant pipe 13 is closed and the air pump 19 side valve is opened. The purging of the present embodiment is carried out at the end of each cycle in order to prevent an accumulation of foreign matter inside the spiral flow channel 35 of the core pin 3; however, the purging may be carried out once every plurality of cycles, or, the purging itself may be omitted by installing a filter for removing foreign matter in the refrigerant pipe 13. In the present embodiment, purging is carried out using air; however, the purge medium is not limited to air, and may be an appropriate cleaning liquid as well.

The controller 17 is configured from a computer comprising ROM, RAM, CPU, HDD, and the like, and carries out a control to supply refrigerant synchronously with the operation of the casting device 1, by inputting an operating signal from a casting controller 18 of the casting device 1. A control table, generated experimentally or by computer simulation in advance, is stored in a storage unit, such as a HDD, and a control signal is output to the cooling controller 12, specifically to the circulation pump 14, the temperature regulator 15, the flow rate regulator 16, the electrically controlled three-way valve 132, and the air pump 19, to control the amount of cooling energy that is applied to the core pin 3 during the next casting cycle, in accordance with the detected temperature of the core pin 3 that is detected by the temperature detector 11. FIG. 6 is a view illustrating one example of a control table that is stored in the HDD of the controller 17. The illustrated control table shows an example of a case in which the supply time of the refrigerant is controlled, indicating that, when the temperature detected by the temperature detector 11 varies toward the high temperature side by $+\alpha_1$ to $+\alpha_5$° C., and toward the low temperature side by $-\alpha_1$ to $-\alpha_5$° C. relative to a target value (reference value), the supply time of the refrigerant is respectively increased by $+\beta_1$ to $+\beta_5$ seconds and $-\beta_1$ to $-\beta_5$ seconds, relative to the supply time of the refrigerant in the previous cycle. Instead of, or in addition to, the supply time of the refrigerant, a control table for controlling the supply amount of the refrigerant in the same manner may be stored. In addition to the above, a control table for controlling the temperature of the refrigerant in the same manner may be stored.

The control of the amount of cooling energy that is applied to the core pin 3 during the next casting cycle, in accordance with the detected temperature of the core pin 3 that is detected by the temperature detector 11, which is carried out by the controller 17, is realized by controlling the circulation pump 14 or the flow rate regulator 16, such that, as the detected temperature becomes higher than the reference temperature, the supply time of the refrigerant is increased and/or the flow rate of the refrigerant is increased. In addition, the circulation pump 14 or the flow rate regulator 16 is controlled, such that, as the detected temperature becomes lower than the reference temperature, the supply time of the refrigerant is decreased and/or the flow rate of the refrigerant is decreased. Furthermore, when adjusting the temperature of the refrigerant by controlling the temperature regulator 15 with the controller 17, the temperature regulator 15 is controlled such that, as the detected temperature becomes higher than the reference temperature, the temperature of the refrigerant is decreased, and the temperature regulator 15 is controlled such that, as the detected temperature becomes lower than the reference temperature, the temperature of the refrigerant is increased.

Figure 5:
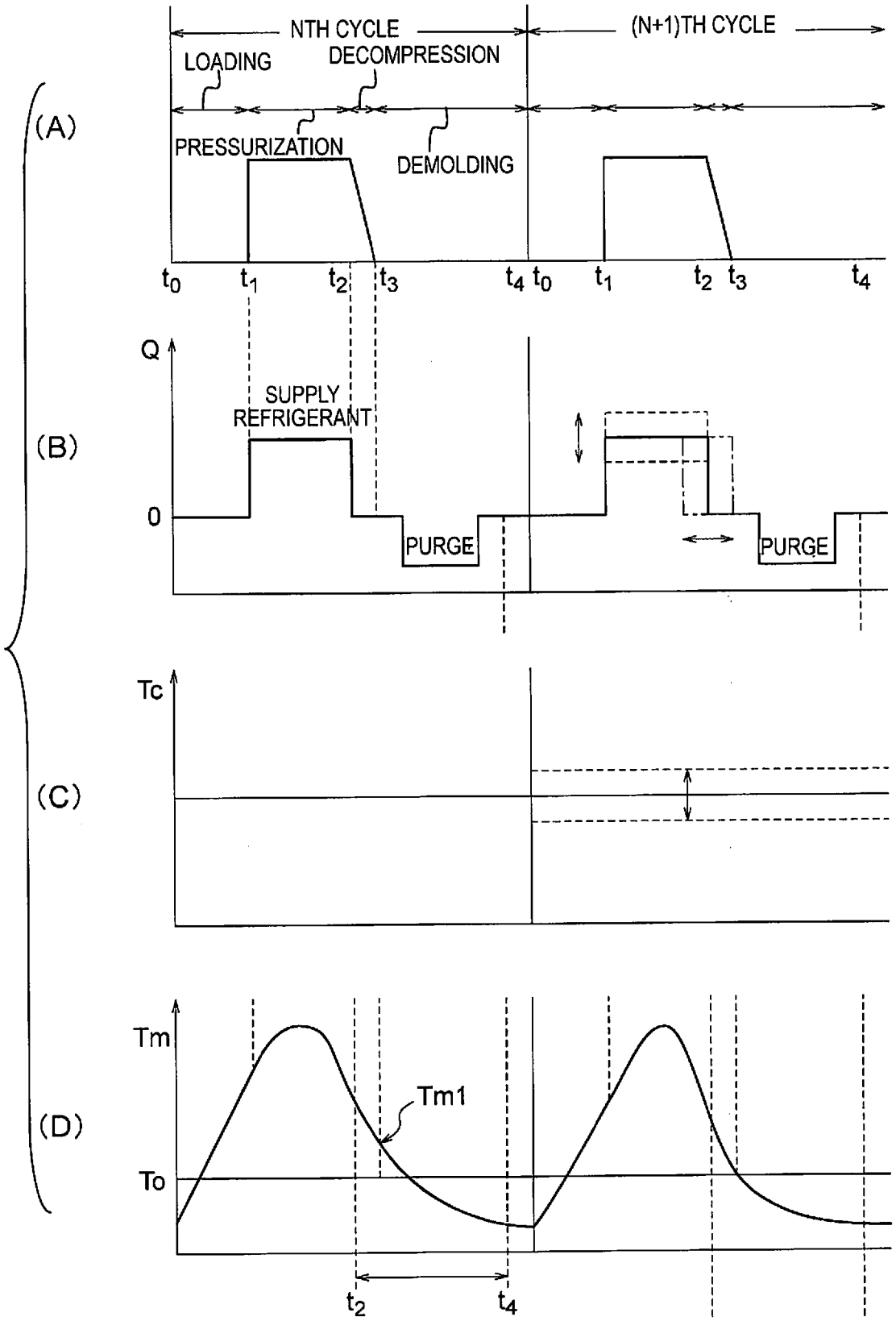
FIG. 5 is a series of time charts illustrating a casting method that uses the casting device of FIGS. 3 and 4.

Next, the operation will be described. FIG. 5 is a time chart illustrating a casting method that uses the casting device 1 of the present embodiment, in which only two cycles, the Nth cycle and the (N+1)th cycle, are shown. The preceding and succeeding cycles are a repetition of the above, and thus are omitted. The time chart (A) of FIG. 5 illustrates each step of the cast molding by the casting device 1, in which molten metal such as aluminum alloy is injected into a cavity 25 of the casting die 2, which is clamped as shown in FIG. 3, during time $t_0$-$t_1$. When pouring of the molten metal into the cavity 25 is completed at time $t_1$, the injection pressure is increased, and pressurization is carried out at a predetermined pressure for a predetermined time $t_1$-$t_2$. Then, pressurization is completed at time $t_2$, the pressure is reduced until time $t_3$, and after time $t_3$, the casting die 2 is cooled and opened to release the cast product (time $t_3$-$t_4$). This is repeated in the subsequent (N+1)th cycle as well.

In the cast molding cycle described above, the casting device 1 of the present embodiment carries out the following control in order to apply cooling energy to the core pin 3. The time chart (B) of FIG. 5 illustrates the flow rate Q of the refrigerant that is supplied to the spiral flow channel 35 of the core pin 3, the time chart (C) of FIG. 5 illustrates the temperature Tc of the refrigerant that is supplied to the spiral flow channel 35 of the core pin 3, and the time chart (D) of FIG. 5 illustrates the profile of the detected temperature Tm of the core pin 3 that is detected by the temperature detector 11. Before carrying out the cast molding of the Nth cycle, so-called trial casting at the time of the start of the step is carried out, and the supply time of the refrigerant, the refrigerant flow rate, and the refrigerant temperature of the Nth cycle are set based on the detected temperature Tm that is detected at the time of this trial casting.

During time $t_0$-$t_1$ of the Nth cycle, until the molten metal such as aluminum alloy is injected, the controller 17 stops the supply of refrigerant to the core pin 3 by stopping the circulation pump 14 or by setting the flow rate of the flow rate regulator 16 to zero. In addition, the electrically controlled three-way valve 132 is set so that the refrigerant is supplied to the refrigerant inlet 36 of the core pin 3, and the air pump 19 is brought to a stopped state.

The controller 17 starts the supply of refrigerant to the core pin 3 by actuating the circulation pump 14 or by setting the flow rate of the flow rate regulator 16 to a predetermined value at the same time as receiving a signal from the casting controller 18 indicating that the pouring of the molten metal into the cavity 25 has been completed at time $t_1$. The supply time and the flow rate of the refrigerant as well as the temperature of the refrigerant at this time are set based on the detected temperature Tm of the core pin 3 that is detected during the previous cycle, as described above; therefore, the controller 17 outputs a corresponding control signal to the circulation pump 14, the temperature regulator 15, and the flow rate regulator 16. In the example illustrated in the time chart (B) of FIG. 5, the supply time of the refrigerant is set to the same $t_1$-$t_2$ as the time of the pressurization step.

When it is determined that the supply time of the refrigerant has expired (time $t_2$), the controller again stops the supply of refrigerant to the core pin 3 by stopping the circulation pump 14 or by setting the flow rate of the flow rate regulator 16 to zero. At this time, in the casting die 2, the pressurization is ended and the pressure is reduced until time $t_3$. At time $t_3$, when the decompression is ended, the temperature of the core pin 3 is measured by the temperature detector 11. As described above, the timing of the temperature detection of the core pin 3 is not limited to this time $t_3$, and may be time $t_4$. Here, it is assumed that the detected temperature is $T_{m1}$ (>reference temperature $T_0$), as illustrated in the time chart (D) of FIG. 5.

The controller 17 compares the detected temperature that is detected by the temperature detector 11 and the reference temperature and calculates the difference therebetween. Then, with reference to the control table illustrated in FIG. 6, the added value of the supply time of the refrigerant that corresponds to the calculated temperature difference is obtained. During time $t_3$-$t_4$, in which the casting die 2 is opened and the cast product is released, the controller 17 outputs a control signal to the electrically controlled three-way valve 132 to open the air pump 19 side valve and to close the flow rate regulator 16 side valve of the refrigerant pipe 13. In addition, a control signal is output from the controller 17 to the air pump 19 to operate the air pump 19. As a result, the refrigerant that is loaded in the refrigerant pipe 13 from the electrically controlled three-way valve 132 to the refrigerant inlet 36, the spiral flow channel 35, the refrigerant outlet 37, and the refrigerant tank 131, is discharged to the refrigerant tank 131, and the flow channel of this pipe is purged with air. When this air purge is completed, the controller 17 outputs a control signal to the electrically controlled three-way valve 132 to close the air pump 19 side valve and to open the flow rate regulator 16 side valve of the refrigerant pipe 13. In addition, a control signal is output from the controller 17 to the air pump 19 to stop the air pump 19.

In the next (N+1)th cycle, the controller 17 starts the supply of refrigerant to the core pin 3 by actuating the circulation pump 14 or by setting the flow rate of the flow rate regulator 16 to a predetermined value at the same time as receiving a signal from the casting controller 18 indicating that the pouring of the molten metal into the cavity 25 has been completed at time $t_1$. The supply time and the flow rate of the refrigerant as well as the temperature of the refrigerant at this time are set based on the detected temperature $T_{m1}$ of the core pin 3 that is detected at time $t_3$ during the previous Nth cycle; therefore, the controller 17 outputs a corresponding control signal to the circulation pump 14, the temperature regulator 15, and the flow rate regulator 16. In the example of the (N+1)th cycle illustrated in the time chart (B) of FIG. 5, the correction range of the supply time of the refrigerant is indicated by the dashed-dotted line, and the correction range of the flow rate of the refrigerant is indicated by the dotted line. In addition, the correction range of the refrigerant temperature in the time chart (C) of FIG. 5 is indicated by the dotted line. As described above, since the detected temperature $T_{m1}$ that is detected in the Nth cycle is higher than the reference value $T_0$, the supply time of the refrigerant in the (N+1)th cycle is set to be relatively short, the flow rate of the refrigerant is set to be relatively high, and the temperature of the refrigerant is set to be relatively low. Any one of the supply time and the flow rate of the refrigerant as well as the temperature of the refrigerant may be controlled, or a combination of at least two thereof may be controlled.

Figure 8:
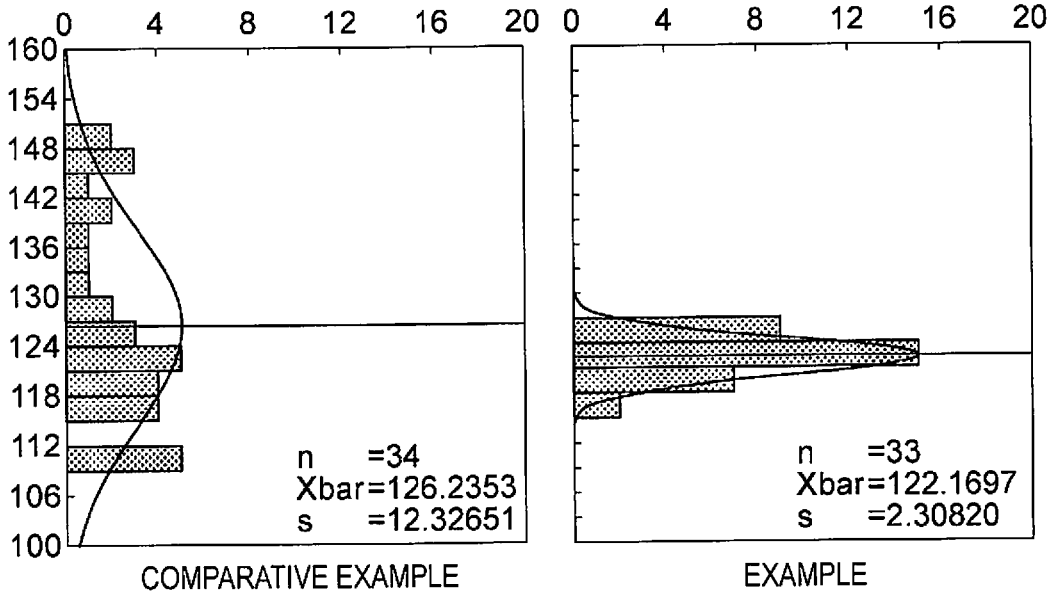
FIG. 8 shows histograms illustrating the temperature of the core pin when the cooling energy that is applied to the core pin is controlled using the casting device of FIGS. 3 and 4, and the temperature of the core pin when the cooling energy that is applied to the core pin is not controlled using the same device.

With the control described above, as indicated by the temperature profile of the (N+1)th cycle in the time chart (D) of FIG. 5, the temperature Tm of the core pin 3 at time $t_3$ approaches the reference temperature $T_0$. The drawing on the right-hand side of FIG. 8 is a histogram illustrating the temperature (vertical axis) of the core pin 3 when the cooling energy that is applied to the core pin 3 is controlled using the casting device 1 of the present embodiment according to the procedure described above, and the drawing on the left of FIG. 8 is a histogram illustrating the temperature of the core pin when the cooling energy that is applied to the core pin 3 is not controlled using the same casting device 1 according to the procedure described above. In the figure, n represents the number of samples, $X_{bar}$ represents the mean value, and s represents the standard deviation. As illustrated by the drawing on the right-hand side of the figure, when the cooling energy control of the present embodiment is carried out, the standard deviation becomes one-sixth of the value compared to when the control is not carried out; therefore, it was confirmed that the cyclical variation in temperature of the core pin 3 was effectively suppressed.

As described above, according to the casting device and the casting method of the present embodiment, since the cooling energy that is applied to the core pin 3 in the subsequent cycle is controlled in accordance with the temperature that is detected and the end of the casting cycle $t_2$-$t_4$, when the temperature of the core pin 3 becomes relatively stable, it is possible to suppress the cyclical variation in temperature of the core pin 3 during casting.

In addition, according to the casting device and the casting method of the present embodiment, since the supply time and/or flow rate of the refrigerant is controlled, the responsiveness and the accuracy are relatively high compared to the refrigerant temperature, it is possible to further suppress the cyclical variation in temperature of the core pin 3 during casting.

Additionally, according to the casting device and the casting method of the present embodiment, since the temperature of the refrigerant is also controlled, it is particularly effective when the correction amount is large, and control cannot be carried out only by the supply time and the flow rate of the refrigerant.

In addition, according to the casting device and the casting method of the present embodiment, since the refrigerant that is loaded in the spiral flow channel 35 of the core pin 3 is purged when the supply of refrigerant to the core pin 3 is ended, it is possible to prevent an inhibition of the circulation of the refrigerant due to foreign matter clogging the spiral flow channel 35. In particular, since such purging of the refrigerant is carried concurrently with the demolding step of casting, the manufacturing time will not be increased.

Additionally, according to the casting device and the casting method of the present embodiment, since the core pin 3 is configured from an outer cylinder 31 and an inner cylinder 32, and particularly since a spiral groove 33 is formed on the outer surface of the inner cylinder 32 rather than the outer cylinder 31, the operational efficiency of precise machining is enhanced, and it is also possible to manufacture a core pin 3 at low cost.

In addition, according to the casting device and the casting method of the present embodiment, if double spiral grooves 33A, 33B are formed on the outer surface of the inner cylinder 32 of the core pin 3, it is possible to apply cooling energy to the outer cylinder 31 both in the outward and inward directions of the refrigerant; therefore, the cooling efficiency is increased.

Additionally, according to the casting device and the casting method of the present embodiment, by setting the axial direction pitch of the spiral groove 33, which is formed on the outer surface of the inner cylinder 32 of the core pin 3, such that the distal end side pitch is smaller (narrower) than the proximal end side pitch, the temperature gradient of the core pin 3 becomes small and it becomes possible to achieve conservation of the cooling energy, while reducing the cooling time of the casting step.

The invention claimed is:

1. A casting device that carries out casting by supplying molten metal to a cavity formed inside a casting die in a state in which a core pin is disposed in the casting die, the casting device comprising:

a temperature detector that detects a temperature of the core pin at a predetermined time after pressurization has ended in a casting cycle, and a cooling controller for applying cooling energy to the core pin, the controller configured to control an amount of cooling energy applied to the core pin during the casting cycle based on a detected temperature that is detected by the temperature detector in an immediately previous casting cycle.

2. The casting device as recited in claim 1, wherein the cooling controller includes:

a circulation system that circulates a refrigerant in a vicinity of a surface of the core pin;

a flow rate regulator that adjusts a flow rate and a supply time of the refrigerant that is supplied to the core pin; and a controller that controls the flow rate regulator to control one of the flow rate and the supply time of the refrigerant according to the detected temperature.

3. The casting device as recited in claim 2, wherein the controller controls the flow rate regulator such that:

as the detected temperature becomes higher than a reference temperature, at least one of the supply time and the flow rate of the refrigerant is increased, and as the detected temperature becomes lower than the reference temperature, at least one of the supply time and the flow rate of the refrigerant is decreased.

4. The casting device as recited in claim 2, wherein:

the cooling controller further comprises a temperature regulator that adjusts the temperature of the refrigerant that is supplied to the core pin, and the controller controls the temperature regulator according to the detected temperature, and controls the amount of cooling energy that is applied to the core pin during the casting cycle.

5. The casting device as recited in claim 2, wherein the cooling controller purges the refrigerant that is loaded in the circulation system during a period from a completion of the casting cycle until a next casting cycle is started.

6. The casting device as recited in claim 1, wherein the core pin comprises:

an outer cylinder having a tubular shape having a bottom portion, and an outer surface thereof that defines an outer surface of the core pin, and an inner cylinder having an outer surface with a spiral groove, and a through-hole that extends through in an axial direction, a spiral flow channel in which the refrigerant flows is formed between an inner surface of the outer cylinder and the spiral groove of the inner cylinder, one end of the spiral flow channel and one end of the through-hole are linked by the inner cylinder being disposed in the outer cylinder, and the other end of the through-hole being one of an inlet and an outlet of the refrigerant, and the other end of the spiral flow channel being the other of the inlet and the outlet of the refrigerant.

7. The casting device as recited in claim 6, wherein the spiral flow channel has an axial direction interval that becomes narrower or a cross-sectional area that becomes larger as the spiral flow channel approaches toward a distal side of the core pin.

8. The casting device as recited in claim 1, wherein the core pin comprises:

an outer cylinder having a tubular shape having a bottom portion, and an outer surface thereof that defines an outer surface of the core pin, and an inner cylinder having an outer surface in which double spiral grooves linked at distal ends are formed, a spiral flow channel in which the refrigerant flows is formed between an inner surface of the outer cylinder and the double spiral grooves of the inner cylinder by the inner cylinder being disposed in the outer cylinder, and one end of the spiral flow channel becomes one of an inlet and an outlet of the refrigerant, and the other end of the spiral flow channel becomes the other of the inlet and the outlet of the refrigerant.

9. A casting method in which casting is carried out by supplying molten metal to a cavity formed inside a casting die in a state in which a core pin is disposed in the casting die, the casting method comprising:

a step for detecting a temperature of the core pin at a predetermined time at an end of one casting cycle, and a step for applying cooling energy to the core pin and for controlling an amount of cooling energy applied to the core pin during a next casting cycle according to a detected temperature that is detected in the step for detecting the temperature of the core pin.

10. The casting method as recited in claim 9, wherein in the step for controlling the amount of cooling energy, control is carried out such that as the detected temperature becomes higher than a reference temperature, at least one of a supply time and a flow rate of the refrigerant that is supplied to the core pin is increased, and as the detected temperature becomes lower than the reference temperature, at least one of the supply time and the flow rate of the refrigerant is decreased.

11. The casting method as recited in claim 9, wherein the step for controlling the amount of cooling energy includes a step for adjusting the temperature of the refrigerant that is supplied to the core pin, and the temperature of the refrigerant that is supplied to the core pin during the casting cycle is adjusted according to the detected temperature.

12. The casting method as recited in claim 9, further comprising a step for purging the refrigerant that is supplied to the core pin, during a period from a completion of the one casting cycle until the next casting cycle is started.

* * * * *